US009975227B1

(12) United States Patent
Gough

(10) Patent No.: US 9,975,227 B1
(45) Date of Patent: May 22, 2018

(54) CUSTOMIZED TOOL

(71) Applicant: Kyle Gough, Costa Mesa, CA (US)

(72) Inventor: Kyle Gough, Costa Mesa, CA (US)

( * ) Notice: Subject to any disclaimer, the term of this patent is extended or adjusted under 35 U.S.C. 154(b) by 10 days.

(21) Appl. No.: 14/936,586

(22) Filed: Nov. 9, 2015

Related U.S. Application Data

(60) Provisional application No. 62/077,846, filed on Nov. 10, 2014.

(51) Int. Cl.
*B25B 27/24* (2006.01)

(52) U.S. Cl.
CPC ..... *B25B 27/24* (2013.01)

(58) Field of Classification Search
CPC ..... Y10T 137/7413; Y10T 137/7439; Y10T 137/7455; Y10T 137/7462; F16K 31/34; B25B 27/24; B01L 2200/0684
USPC ..... 137/322, 410, 434, 436, 437, 438, 439, 137/441, 445, 446; 3/322, 410, 434, 436, 3/437, 438, 439, 441, 445, 446
See application file for complete search history.

(56) References Cited

U.S. PATENT DOCUMENTS 1,389,667 A * 9/1921 Kraft ..... B25B 27/02 29/265
2,889,849 A * 6/1959 Shohan ..... A01G 25/16 137/322
2,898,128 A * 8/1959 Shohan ..... F16K 1/14 137/322
3,424,181 A * 1/1969 Morse ..... F16K 1/306 137/316
3,645,496 A * 2/1972 Rawlins ..... F25B 45/00 137/322
3,718,057 A * 2/1973 Berchtold ..... B60C 25/18 81/15.4
4,736,926 A * 4/1988 Fallon ..... B67D 1/0832 137/212
5,139,049 A * 8/1992 Jensen ..... F16L 37/34 137/614.03
5,191,912 A * 3/1993 McDaniel ..... F16K 31/34 137/270
5,623,959 A * 4/1997 Granmoe ..... B25B 13/48 137/322
6,006,784 A * 12/1999 Tsutsui ..... E03C 1/0403 137/359
6,244,829 B1 * 6/2001 Yumoto ..... F16T 1/24 137/165
6,253,436 B1 * 7/2001 Barjesteh ..... B25B 27/24 29/213.1

(Continued)

*Primary Examiner* — Reinaldo Sanchez-Medina
(74) *Attorney, Agent, or Firm* — Rutan & Tucker, LLP

(57) ABSTRACT

A customized tool for use in release pressure and liquid from a valve, the customized tool comprising a body component including a conduit having a first end and a second end, the first end operating as an inlet having a size of a first diameter, an arm component including a conduit and a threaded outlet port, the conduit of the arm component forming an angled pathway with the conduit of the body component, a limit rod that threadably couples with the second end of the body component, at least a portion of the limit rod being threaded, a fastener that threadably couples to the limit rod and is used to limit a movement of the limit rod, and a limit rod stopper to threadably receive the limit rod and abut the limit rod stopper to restrict the movement of the limit rod is shown.

18 Claims, 7 Drawing Sheets

(56) References Cited

U.S. PATENT DOCUMENTS 6,273,397 B1 * 8/2001 Schultz ..... F25B 41/003
137/614.18
9,375,715 B2 * 6/2016 Norwood ..... B01L 3/567

* cited by examiner

CUSTOMIZED TOOL

FIELD

Embodiments of the disclosure relate to the use and operation of valves. More specifically, embodiments of the disclosure relate to an apparatus for enabling an operator to release pressure and liquid from a valve such as a combination air valve.

GENERAL BACKGROUND

A combination air valve is a type of valve typically located at a high point in a piping system and manufactured to perform functions of an air release valve and an air/vacuum valve. A combination air valve typically includes a hollow bowl having an inlet port that couples to the piping system on a first side and an outlet port for releasing liquid and/or gas (e.g., air) on a second side. The combination air valve also includes an orifice plug coupled to a float. The float floats in the liquid contained within the hollow bowl pushing the orifice plug against an opening in the hollow bowl leading to the outlet port.

Current tools used to engage the orifice plug of a combination air valve and release the liquid and/or air contained within the hollow bowl are often clumsy and do not provide an operator with easy access to the orifice plug. Additionally, current tools often result in leakages at the site of engagement of the orifice plug. Similarly, various valves having analogous functions such as air release valves, sewage air release valves, single body sewage combination air valves, and/or sewage air and/or vacuum valves.

Based on the problems presented by various valves and current tools used to engage the orifice plug and release the liquid and/or air contained within the valve, current tools fail to provide easy access to the orifice plug, prevent leakages at the site of engagement with the orifice plug and direct the liquid and/or air in a desired direction.

BRIEF DESCRIPTION OF THE DRAWINGS

Embodiments of the invention are illustrated by way of example and not by way of limitation in the figures of the accompanying drawings, in which like references indicate similar elements and in which.

DETAILED DESCRIPTION

Figure 1A:
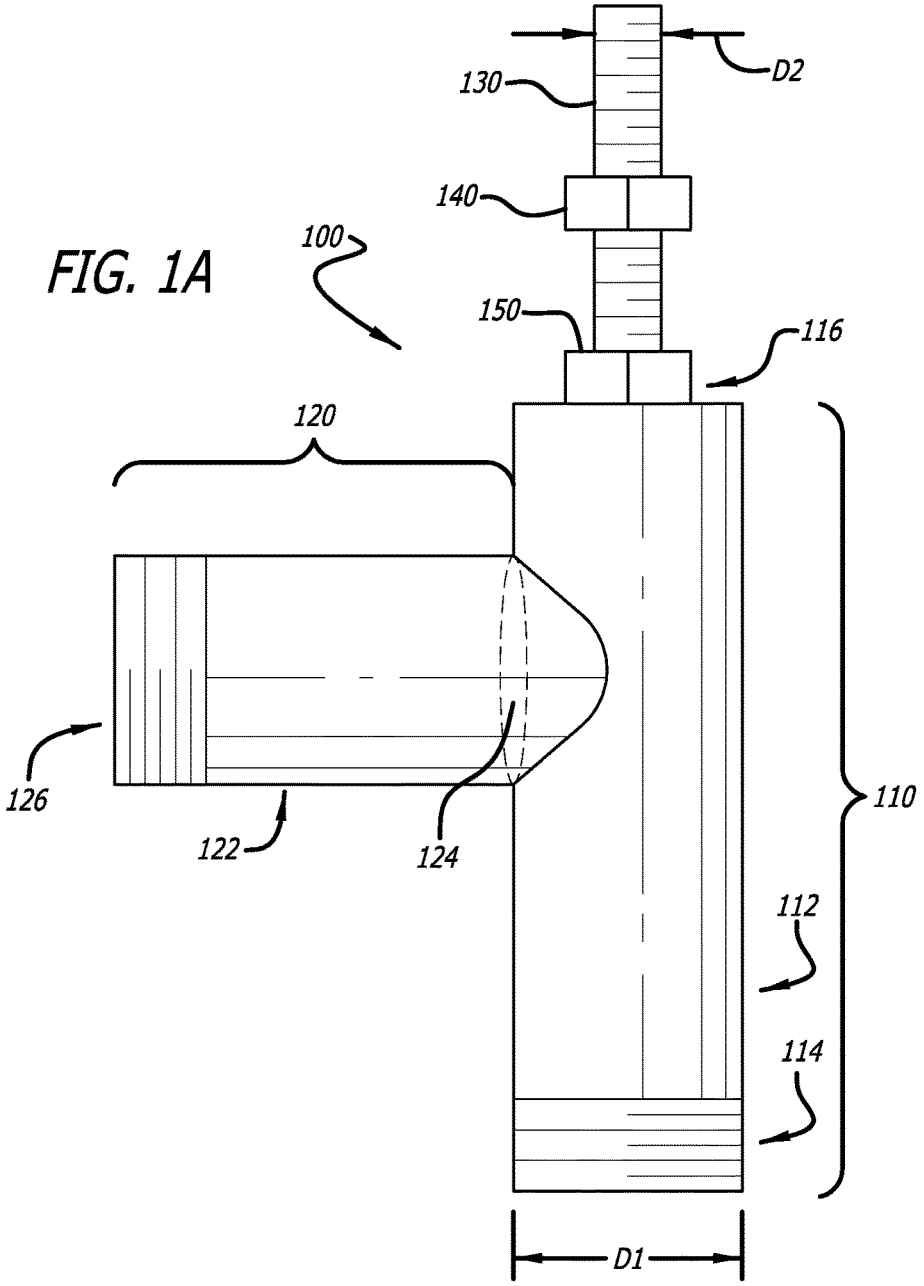
FIG. 1A is a first exemplary embodiment of a customized tool.

Various embodiments of the invention relate to a customized tool and a method for adjusting features of the customized tool to suit its operator.

In the following description, certain terminology is used to describe features of the invention. For instance, the term "customized tool" may refer to any single-operator device that is adapted as a conveyance for flushing and maintaining any combination air valve.

The term "combination air valve" should be interpreted as a valve that performs functions of both an air/vacuum valve and an air release valve. Specifically, a combination air valve may perform the functions of exhausting large quantities of air at system start-up, admitting air at system shut-down and releasing air during system operation. Herein, the disclosure will use a combination air valve as an example throughout to illustrate properties of the invention. However, as many of the valve types mentioned above (e.g., air release valves, sewage air release valves, single body sewage combination air valves, and/or sewage air and/or vacuum valves) include analogous functionality and properties similar to a combination air valve, the invention disclosed herein may be used for any of the valve types mentioned above.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

While this invention is susceptible to embodiments of many different forms, there is shown in the drawings and will herein be described in detail specific embodiments, with the understanding that the present disclosure is to be considered as an example of the principles of the invention and not intended to limit the invention to the specific embodiments shown and described.

I. General Overview

An embodiment of a customized tool for enabling an operator to release pressure and liquid from a combination air valve is described herein. The customized tool comprises a body component, an arm component and an adjustable limit rod that can be configured to adjust the liquid flow from a combination air valve. The limit rod may be placed in one of a first (raised) position that precludes the release of liquid, a second (lowered) position that allows for a release of liquid via the combination air valve at a first flow rate, or a third (intermediary) position where the combination air valve is partially open to achieve a second flow rate that is less than the first flow rate. Furthermore, the arm component comprises an outlet having a threaded connection component. The outlet allows for a hose or any other threaded accessory to be attached to the arm component guiding the released liquid in a predetermined direction.

II. General Architecture

Referring to FIG. 1A, a first exemplary embodiment of a customized tool 100 is shown. Herein, the customized tool 100 comprises a body component 110, an arm component 120, a limit rod 130, a fastener 140 and a limit rod stopper 150. One or more portions of the customized tool 100 may be made of a hardened material. Examples of hardened materials from which the customized tool 100 may be made include, but are not limited or restricted to, galvanized steel, a hardened polymer (e.g., Polyvinyl Chloride "PVC"), stainless steel, brass, titanium, cast iron, ductile iron, black steel, steel with chrome plating and/or aluminum. In one embodiment, the body component 110, the arm component 120 and the limit rod stopper 150 are integrally formed.

Figure 1B:
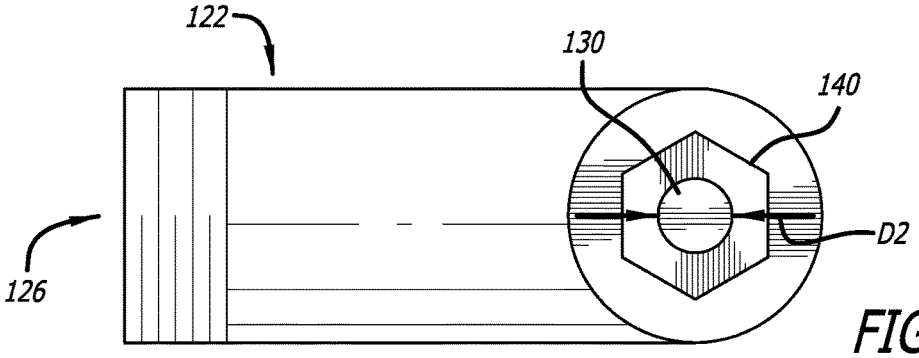
FIG. 1B is a downward planar view of the customized tool of FIG. 1A.

The body component 110 comprises a conduit 112 that includes a first end 114, which may be tapered or non-tapered, and a second end 116. The first end 114 operates as an inlet, which is sized with a first diameter (D1). The second end 116 is partially enclosed with the limit rod stopper 150. According to one embodiment of the disclosure, the limit rod stopper 150 has a "nut" configuration with a threaded opening of a second diameter (D2) that is less than the first diameter (D1). In fact, the second diameter (D2) is sized to receive the limit rod 130 that is threaded into the opening of the limit rod stopper 150 as shown in FIG. 1B. In one embodiment, the limit rod 130 threadably couples with the second end 116 of the body component 110 (e.g., via the limit rod stopper or a portion of threads located within the second end 116 itself). In such an embodiment, at least a portion of the limit rod may be threaded.

Figure 2A:
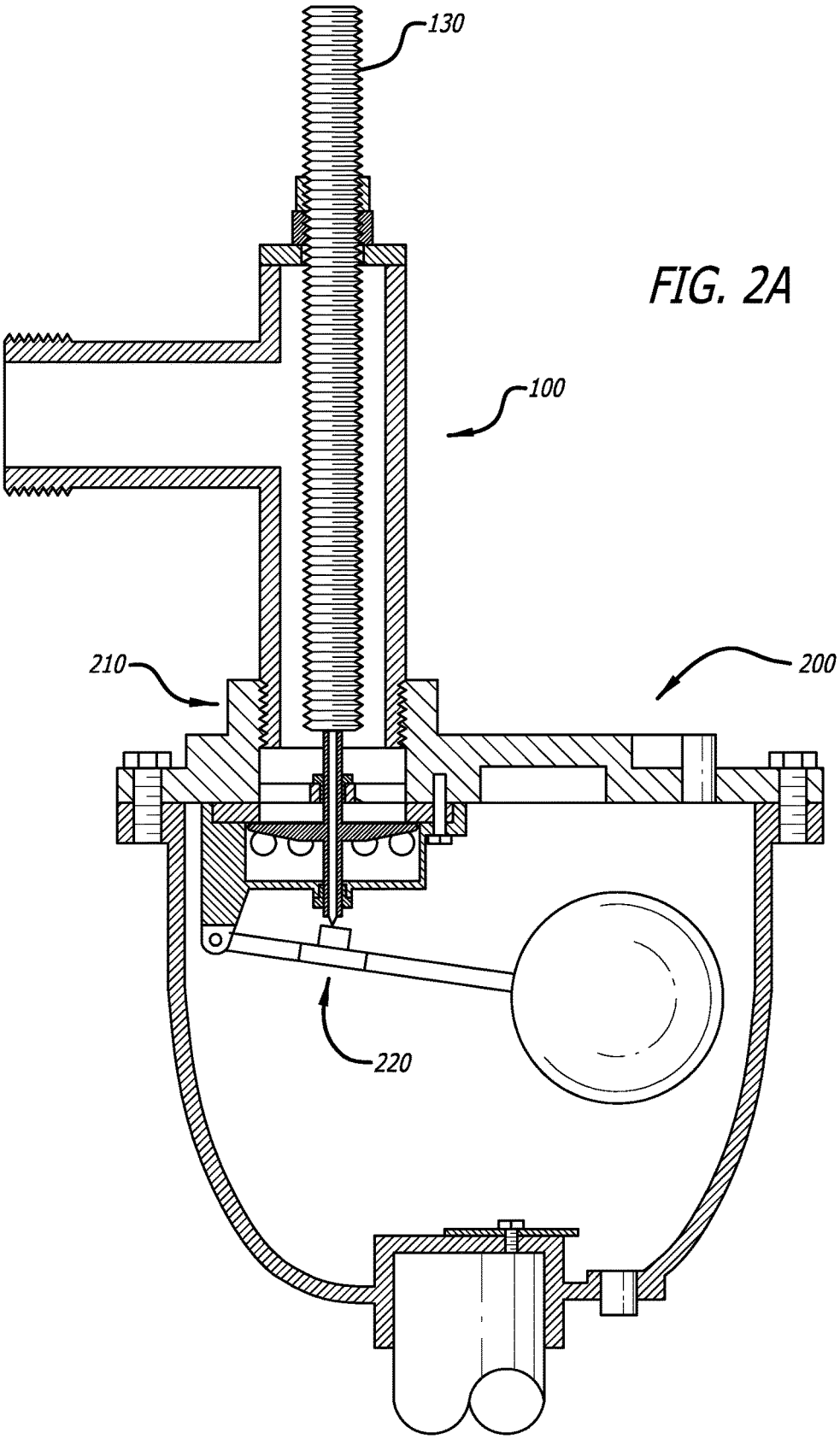
FIG. 2A is an exemplary embodiment of a limit rod of the customized tool of FIG. 1A wherein the limit rod is placed in a first position.
Figure 2B:
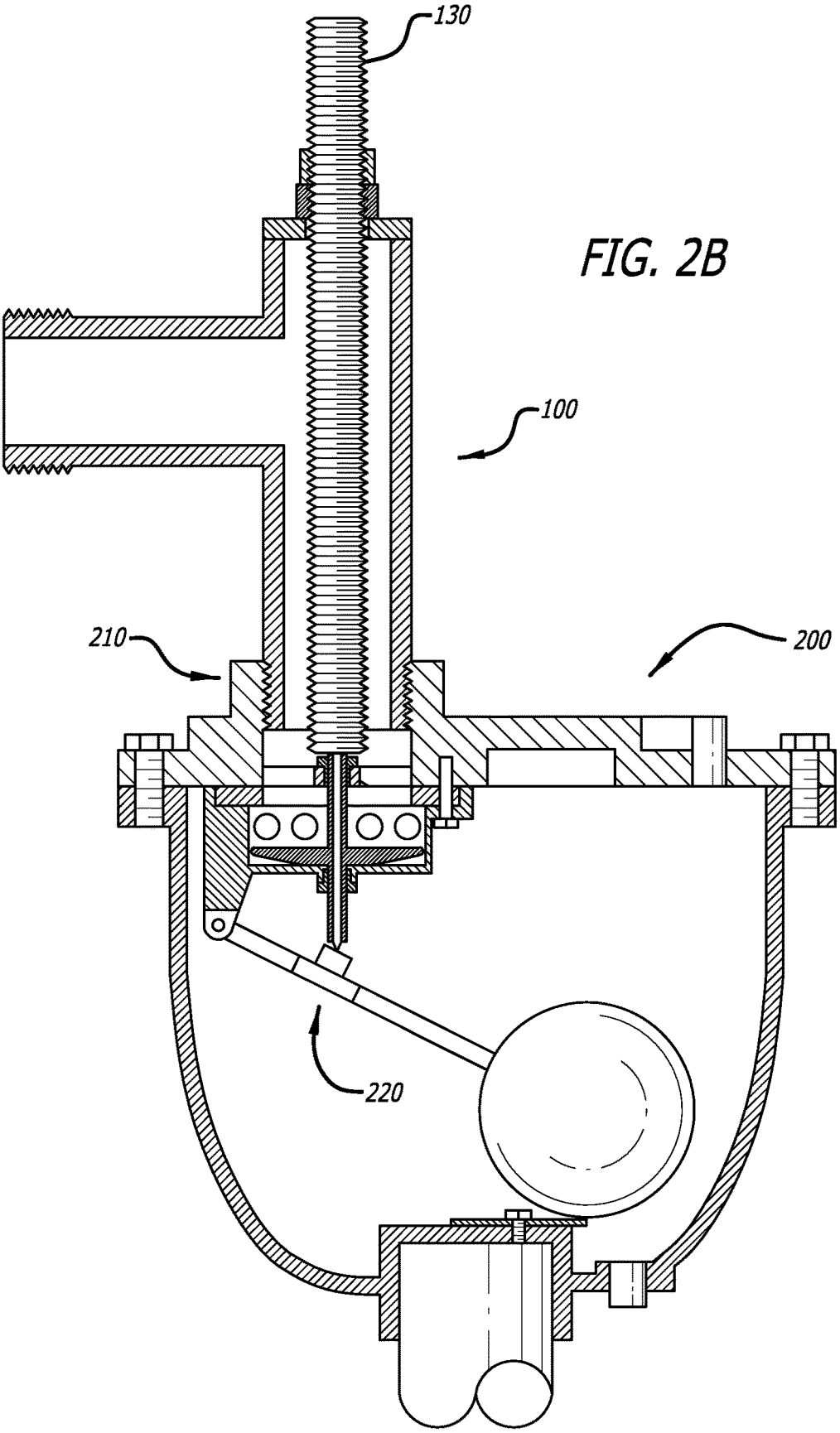
FIG. 2B is an exemplary embodiment of a limit rod of the customized tool of FIG. 1A wherein the limit rod is placed in a second position.
Figure 2C:
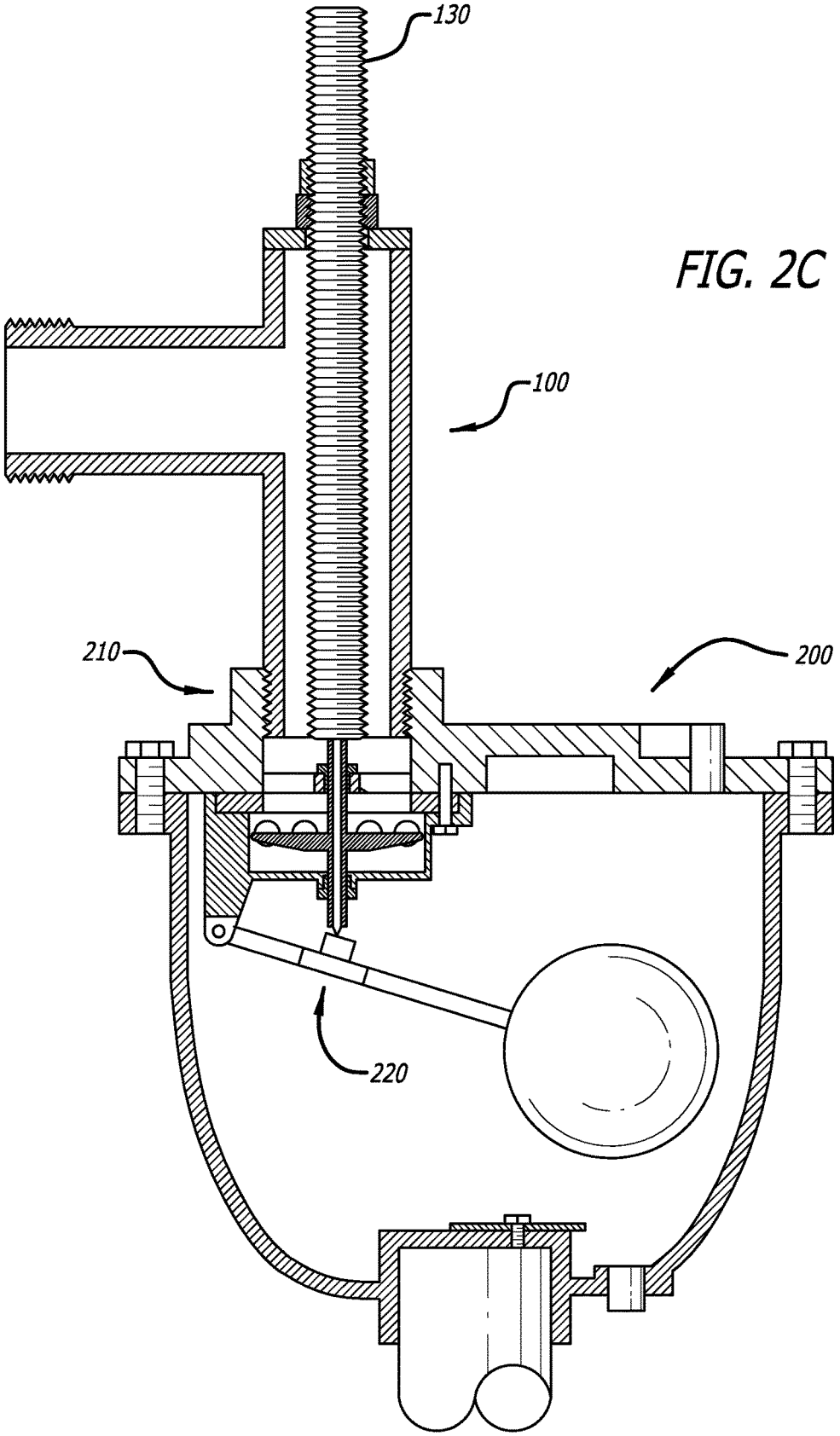
FIG. 2C is an exemplary embodiment of a limit rod of the customized tool of FIG. 1A wherein the limit rod is placed in a third position.

The arm component 120 comprises a conduit 122 that includes an opening 124 and an outlet 126. The opening 124 provides a pathway for a liquid (e.g., water, solution of a particular composition, etc.) from the conduit 112 of the body component 110 in order to provide an angular flow for the liquid from the inlet 114 to the outlet 126 via opening 124 when the inlet 114 is connected to a combination air valve 200 as shown in FIGS. 2A-2C. Both the inlet 114 and outlet 126 may be threaded to provide a leak-resistant connection to the combination air value 200 and a hose, respectively.

When the threaded inlet 114 of the body component 110 is fully engaged to the combination air valve 200, the limit rod 130 can be moved from a first position (e.g., a raised position) to a second position (e.g., a lowered position). In addition, the limit rod 130 may be moved to a third (intermediary) position which may be any position between the first position and the second position. The limit rod 130 moves from the first position to the second position (or to the third position) by moving through the body component 110.

As the limit rod 130 moves from the first position to the second position, an orifice plug 220 of the combination air valve 200, as seen in FIGS. 2A-2C, is compressed thereby creating an opening through which liquid may flow. When the orifice plug 220 of the combination air valve 200 is compressed, liquid flows at a first flow rate from the combination air valve 200 via an outlet port 210 into the body component 110 of the customized tool 100 and out of the arm component 120.

The arm component 120 includes the threaded outlet 126, which allows the liquid that is released from the combination air valve 200 to be directed outward. The threaded outlet 126 of the customized tool 100 of FIG. 1A is the port through which the liquid exits the customized tool 100. The threaded outlet port 126 of the customized tool 100 of FIG. 1A can be used to attach various accessories the operator may use to direct the flow of the exiting water toward a desired location. In addition, the threaded inlet port 114 of the customized tool 100 may be configured to engage one or more of the various accessories.

Examples of the various accessories may include, but are not limited or restricted to, a hose, an extending pipe, and/or a reducing fitting (e.g., a bell reducer fitting or a reducing bushing). For instance, the attachment of a reducing bushing may result in either the outlet port 210 of the combination air valve 200 having a smaller or a larger size than the size of the threaded inlet port 114.

As an illustrative example, if the threaded outlet port 210 of the combination air valve 200 is of a larger or smaller size of the threaded inlet port 114 of the customized tool 100, a reducing bushing may be used to adapt the size so that the customized tool 100 may be used. The reducing bushing may alter the size of the inlet port 114 in the following ways, inter alia, 1" to 2", 3" to 2", 4" to 2", 5", 6", 7" or 8" to 2."

In another embodiment, the arm component 120 may be oriented at an acute or an obtuse angle from a sidewall of the conduit 112 of the body component 110, namely at an angle other than 90 degrees relative to the body component 110.

In another embodiment, although not shown, the limit rod 130 may include a wrench flat toward the second end 116 to assist the operator in tightening or loosening the customized tool 100, with an operations tool, to the combination air valve 200. Examples of an operations tool may include, but are not limited or restricted to, a wrench, a vise grip or the like. Additionally, a customized accessory may be incorporated onto the end of the limit rod 130 toward the threaded inlet port 114 to act as buffer between the limit rod 130 and one or more components of the combination air valve 200. For example, a small pad made from a material softer than that of the limit rod may be attached to the limit rod 130 (e.g., threadably couples to the end of the limit rod 130 near the second end 116) and act as a contacting component for the limit rod 130 with the combination air valve 200.

When the limit rod 130 is in its first position (e.g., a raised position) of FIG. 2A, the limit rod 130 is not pressing against the orifice plug 220, and not allowing liquid to travel through the customized tool 100. Referring to FIG. 2B, the limit rod 130 is shown in the second position (e.g., a lowered position), wherein the limit rod 130 is pressing against the orifice plug 220 compressing the orifice plug 220 by a first amount. The first amount may be, for example, the entire amount that the orifice plug 220 may be compressed. When in the second position, the limit rod 130 is pressed against the orifice plug 220 housed inside the combination air valve 200 enabling the liquid stored within the combination air valve 200 to exit the combination air valve 200 through the customized tool 100. The flow rate at which the liquid exits the combination air valve 200 may be controlled by moving the limit rod 130 between the first position, the second position and/or an intermediary third position having a flow rate that is less than the flow rate achieved when the limit rod 130 is placed in the second position.

For example, as an illustrative embodiment, the positioning of the limit rod 130 at the second position may cause the orifice plug 220 of the combination air valve 200 to be fully compressed thereby allowing the liquid to exit the combination air valve 200 at a highest flow rate. Continuing the example, when the limit rod 130 is placed into the first position, the orifice plug 220 of the combination air valve 200 is not compressed at all, and thereby no liquid is allowed to exit the combination air valve 200. In addition, when the limit rod 130 is placed into the third position, the limit rod 130 compresses the orifice plug 220 to an extent less than that of when the limit rod 130 is placed in the second position. Therefore, an operator may control the rate at which the liquid exits the combination air valve 200 by moving the limit rod 130 from the first position to the second position, from the first position to the third position, from the third position to the second position, and/or from the second position to the third position.

In one embodiment, a fastener 140 may be configured as a threaded nut which can be used for securing the limit rod 130 in place. After tightening the fastener 140 against the limit rod stopper 150, the limit rod 130 is restricted in movement.

When the limit rod 130 is lowered in a third position as shown in FIG. 2C, liquid can leave the customized tool 100 at a lower flow rate than when the limit rod 130 is placed in the second position. With the raising and lowering of the limit rod 130, for example, from the second position to the third position, the operator can adjust the flow rate of the liquid to the desired flow rate. With the limit rod 130 in a first position, the operator can then turn the limit rod 130 clockwise, for example, to start lowering the limit rod 130, which compresses the orifice plug 220 and creates an opening for the combination air valve 200. Each turn to further lower the limit rod 130 will further open the orifice plug 220, thus allowing more liquid to exit the outlet port 126 of the customized tool 100.

In summary, as shown in FIGS. 2A-2C, the customized tool 100 is secured to the combination air valve 200 and is pressing down on the orifice plug 220, allowing liquid to escape at a controlled rate based on the positioning of the limit rod 130.

Figure 3A:
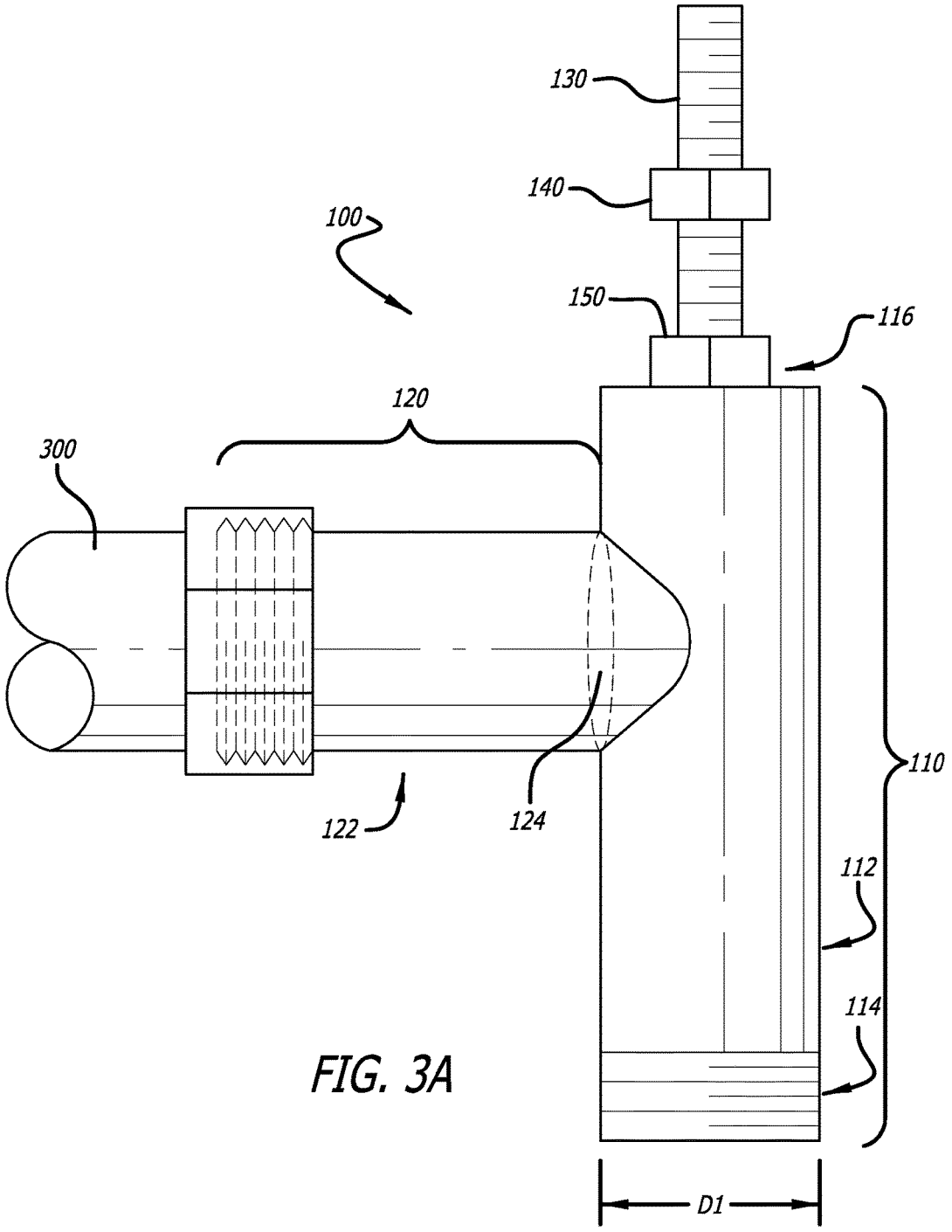
FIG. 3A is an exemplary embodiment of the customized tool of FIG. 1A illustrated as having a first accessory attached to the arm component.

Referring to FIG. 3A, the customized tool of FIG. 1A is illustrated having a first accessory 300 attached to the arm component 120. For instance, an extending hose 300 is attached so that the operator may more efficiently direct the flow of liquid exiting threaded outlet port 126.

Figure 3B:
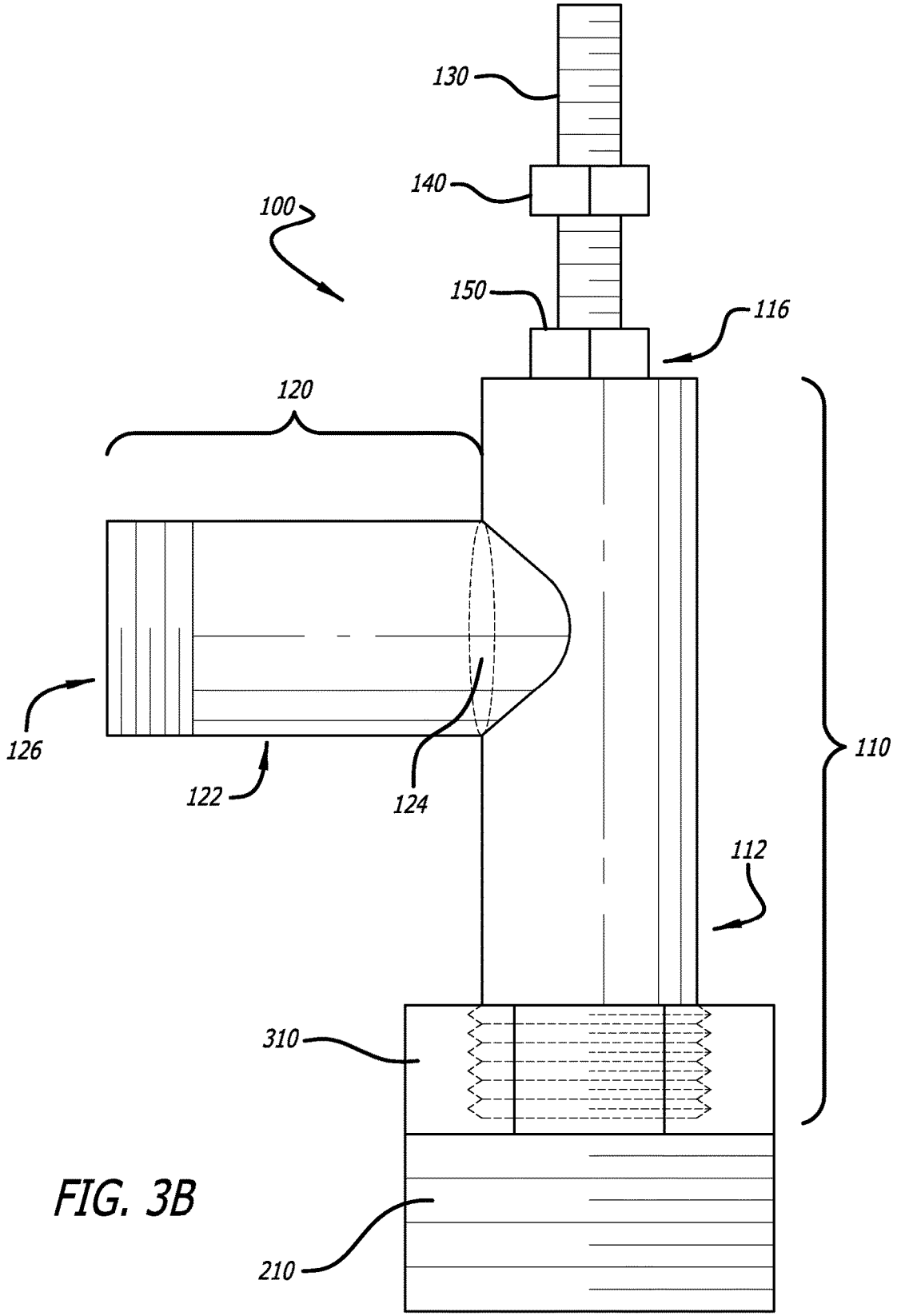
FIG. 3B is an exemplary embodiment of the customized tool of FIG. 1A illustrated as having a second accessory attached to the arm component.

Referring to FIG. 3B, the customized tool of FIG. 1A is illustrated having a second accessory 310 attached to the first end 114 of the body component 110. Herein, a reducing bushing 310 may be used to adapt the size of the outlet port 210 of any combination air valve so that the customized tool 100 may be used. As discussed above, the reducing bushing may be configured as one of various sizes that reduce or enlarge for coupling to the outlet port 210.

Figure 4:
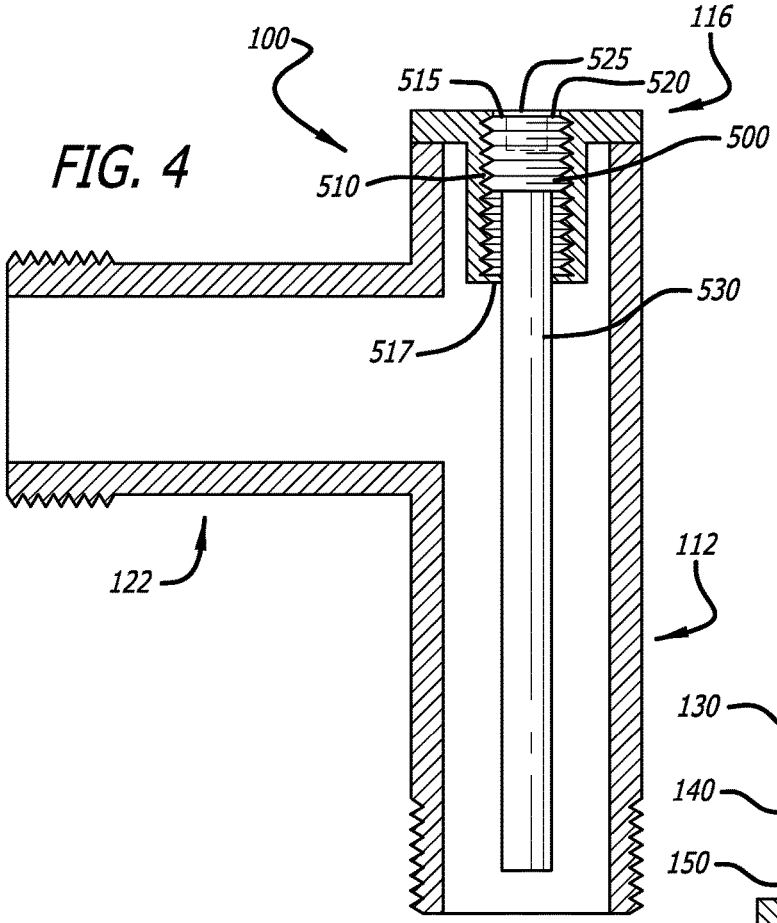
FIG. 4 is a second exemplary embodiment of the customized tool.

Referring now to FIG. 4, a second embodiment of the customized tool 100 is shown. Herein, the customized tool 100 comprises the body component 110 and the arm component 120 of FIG. 1A. However, a limit rod 530 includes an outer-threaded head portion 500 having a diameter that exceeds the diameter of the limit rod 530. The head portion 500 resides within a threaded sheath 510, which is positioned along or proximate to an inner surface of the conduit 112 near the second end 116 and may include a first member 515 (e.g., flange, etc.) to halt upward rotation of the head portion 500 and/or a second member 517 (e.g., a second flange) to halt downward rotation of the head portion 500 beyond a certain distance from a top of the sheath 510. Alternatively, in lieu of a flange, other structures may be used to limit rotational movement of the head portion 500, including appropriate placement of the sheath 510 along the sidewalls of conduit 112.

A top face 520 of the head portion 500 includes an indent 525 in which a hex key (or Allen wretch), any size screwdriver-like tips (e.g., Phillips™, slotted, etc.) may be placed. Rotating the head portion 500 in one direction causes the limit rod 530 to lower. Conversely, rotating the head portion 500 in the other direction causes the limit rod 530 to move upward until a maximum elevated height is reached. For instance, this may be where the top face 520 of the head portion 500 is substantially flush with a closed end 116 of the conduit 112 of the body component 110.

Figure 5:
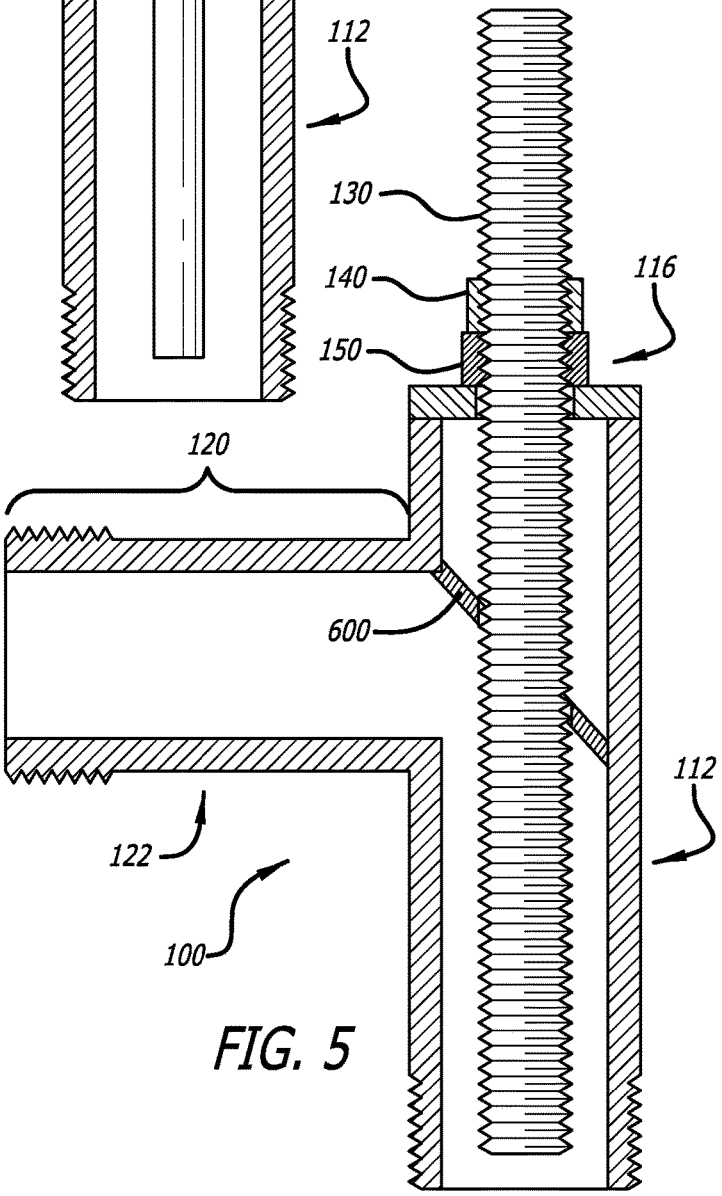
FIG. 5 is an exemplary embodiment of the customized tool of FIG. 1A illustrated as having a baffle.

Referring to FIG. 5, an embodiment of the customized tool 100 is shown. Herein, the body component 110 comprises conduit 112 that may include a baffle 600 to direct liquid more efficiently out through the arm component 120.

In the foregoing description, the invention is described with reference to specific exemplary embodiments thereof. It will, however, be evident that various modifications and changes may be made thereto without departing from the broader spirit and scope of the invention as set forth in the appended claims.

What is claimed is:

1. A customized tool for use in release of pressure or liquid from a valve, the customized tool comprising:

a body component including a first conduit having a first end and a second end, the first end operating as an inlet having a size of a first diameter;

an arm component including a second conduit and a threaded outlet port, the second conduit of the arm component forming an angled pathway with the first conduit of the body component, the second conduit configured to release liquid or gas;

a limit rod that threadably couples with the second end of the body component, at least a portion of the limit rod being threaded;

a limit rod stopper to threadably receive the limit rod, the limit rod stopper being distinct from both the body component and the limit rod; and a fastener that is proximal the limit rod stopper relative to the second end of the body component and configured to traverse the portion of the limit rod, the fastener to threadably couple to the limit rod and to limit a movement of the limit rod when the fastener abuts the limit rod stopper.

2. The customized tool of claim 1, wherein the first end of the first conduit of the body component is tapered.

3. The customized tool of claim 1, wherein the first end of the first conduit of the body component is not tapered.

4. The customized tool of claim 1, wherein the body component, the arm component and the limit rod stopper are integrally formed.

5. The customized tool of claim 1, wherein the body component, the arm component and the limit rod stopper are formed from galvanized steel.

6. The customized tool of claim 1, wherein the body component, the arm component and the limit rod stopper are formed from a hardened polymer.

7. The customized tool of claim 1, wherein the limit rod stopper has a nut configuration with a threaded opening having a size of a second diameter, the second diameter being less than the first diameter of the first end of the first conduit of the body component.

8. The customized tool of claim 1, wherein a reducing bushing is coupled to an inlet port of the customized tool to adapt a size of the inlet port to a size of an outlet port of the valve.

9. A customized tool for use in release of pressure and liquid from a valve, the customized tool comprising:

a body component including a first conduit having a first end and a second end, the first end operating as an inlet having a size of a first diameter;

an arm component including a second conduit configured to release liquid or gas that entered the first conduit of the body component;

a limit rod that threadably couples with the second end of the body component, at least a portion of the limit rod being threaded, wherein the limit rod moves in a first direction to engage an orifice plug of the valve;

a limit rod stopper to receive the limit rod, the limit rod stopper being distinct from the body component; and a fastener that is proximal the limit rod stopper and configured to traverse the portion of the limit rod to limit a movement of the limit rod based on a position of the fastener relative to the limit rod stopper.

10. The customized tool of claim 9, wherein an engagement of the limit rod and the orifice plug creates an opening through which the liquid may flow into the first conduit of the body component.

11. The customized tool of claim 10, wherein the engagement between the limit rod and the orifice plug causes the orifice plug to compress to a first position such that the liquid flows at a first flow rate from the valve into the first conduit of the body component.

12. The customized tool of claim 11, wherein the limit rod engages the orifice plug causing the orifice plug to compress to a second position such that the liquid flows at a second flow rate from the valve into the first conduit of the body component, the second flow rate being greater than the first flow rate.

13. The customized tool of claim 9, wherein the limit rod stopper has a nut configuration with a threaded opening having a size of a second diameter, the second diameter being less than the first diameter of the first end of the first conduit of the body component.

14. The customized tool of claim 9, wherein the first conduit of the body component includes a baffle to direct liquid through the second conduit of the arm component, the arm component fluidly coupled to the body component.

15. A method of using a customized tool, the method comprising:

providing the customized tool, the customized tool including:

a body component including a first conduit having a first end and a second end, the first end operating as an inlet having a size of a first diameter, an arm component including a second conduit and a threaded outlet port, the second conduit of the arm component forming an angled pathway with the first conduit of the body component, a limit rod that threadably couples with the second end of the body component, at least a portion of the limit rod being threaded, a limit rod stopper to threadably receive the limit rod, the limit rod stopper being distinct from the body component, a fastener that is proximal the limit rod stopper and configured to traverse a portion of the limit rod, the fastener threadably couples to the limit rod and is used to limit a movement of the limit rod, and attaching the customized tool to a valve by threadably coupling an outlet port of the valve with the first end of the body component.

16. The method of claim 15 further comprising:

rotating the limit rod in a first direction thereby advancing the limit rod toward the valve to engage an orifice plug of the valve, compressing the orifice plug to a first position such that liquid flows at a first flow rate from the valve into the first conduit of the body component.

17. The method of claim 16, wherein the limit rod engages the orifice plug causing the orifice plug to compress to a second position such that the liquid flows at a second flow rate from the valve into the first conduit of the body component, the second flow rate being greater than the first flow rate.

18. The method of claim 15 further comprising:

rotating the limit rod in a second direction thereby advancing the limit rod opposite the valve to disengage an orifice plug of the valve.

* * * * *